US009188949B2

(12) United States Patent
Sato et al.

(10) Patent No.: US 9,188,949 B2
(45) Date of Patent: Nov. 17, 2015

(54) IMAGE FORMING APPARATUS AND DEVELOPER CARTRIDGE

(75) Inventors: Shougo Sato, Seto (JP); Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 451 days.

(21) Appl. No.: 13/423,338

(22) Filed: Mar. 19, 2012

(65) Prior Publication Data

US 2013/0028632 A1 Jan. 31, 2013

(30) Foreign Application Priority Data

Jul. 29, 2011 (JP) ..... 2011-167116

(51) Int. Cl.
*G03G 15/08* (2006.01)
*G03G 21/16* (2006.01)
*G03G 15/01* (2006.01)

(52) U.S. Cl.
CPC ..... *G03G 21/1676* (2013.01); *G03G 15/0126* (2013.01); *G03G 15/0889* (2013.01); *G03G 21/1642* (2013.01); *G03G 15/0886* (2013.01); *G03G 21/1633* (2013.01); *G03G 2215/0141* (2013.01); *G03G 2221/169* (2013.01); *G03G 2221/1684* (2013.01)

(58) Field of Classification Search
CPC ..... G03G 15/0886; G03G 21/1642; G03G 2221/1684; G03G 21/1633; G03G 2221/169
USPC ..... 399/262, 258
See application file for complete search history.

(56) References Cited

U.S. PATENT DOCUMENTS 6,597,882 B1 * 7/2003 Tanaka ..... 399/258
7,463,847 B2 12/2008 Sato
7,657,206 B2 2/2010 Sato (Continued)

FOREIGN PATENT DOCUMENTS

CN 1797224 A 7/2006
CN 101046657 A 10/2007

(Continued)

OTHER PUBLICATIONS

Non-final Office Action issued in U.S. Appl. No. 13/423,320 mailed Jan. 14, 2014.

(Continued)

*Primary Examiner* — David Gray
*Assistant Examiner* — Tyler Hardman
(74) *Attorney, Agent, or Firm* — Banner & Witcoff, Ltd.

(57) ABSTRACT

A support member that supports developer cartridges is configured to be moved in a predetermined direction between a mounted position and a pulled-out position. A moving mechanism is configured to move a supply member in the developer cartridge between a communication position and an interrupt position when the support member is in the mounted position. When the supply member is in the communication position, a supply opening and a reception opening are in communication with each other and the support member is incapable of moving in the predetermined direction. When the supply member is in the interrupt position, the supply member is moved away from a corresponding image forming unit in the axial direction to interrupt communication between the supply opening and the reception opening and the support member is movable toward the pulled-out position in the predetermined direction.

19 Claims, 9 Drawing Sheets

(56) References Cited

U.S. PATENT DOCUMENTS

| | | | | |
|---|---|---|---|---|
| 7,778,556 | B2 | 8/2010 | Ohkawa et al. | |
| 8,027,620 | B2 | 9/2011 | Sakuma | |
| 8,036,578 | B2 | 10/2011 | Nishikawa | |
| 8,095,048 | B2 | 1/2012 | Awano et al. | |
| 8,190,069 | B2 | 5/2012 | Saiki et al. | |
| 8,244,155 | B2 * | 8/2012 | Kouda | 399/119 |
| 8,396,392 | B2 | 3/2013 | Takakuwa et al. | |
| 2002/0085857 | A1 | 7/2002 | Kim et al. | |
| 2006/0140674 | A1 | 6/2006 | Sato | |
| 2007/0223947 | A1 * | 9/2007 | Ohkawa et al. | 399/27 |
| 2007/0223972 | A1 * | 9/2007 | Isomura | 399/262 |
| 2008/0025758 | A1 * | 1/2008 | Sato | 399/119 |
| 2009/0297209 | A1 * | 12/2009 | Nakajima et al. | 399/110 |
| 2009/0317133 | A1 | 12/2009 | Nishimura et al. | |
| 2010/0092196 | A1 | 4/2010 | Mimura | |
| 2010/0239313 | A1 | 9/2010 | Maeda | |
| 2010/0247156 | A1 * | 9/2010 | Awano et al. | 399/258 |
| 2010/0266310 | A1 | 10/2010 | Saiki et al. | |
| 2010/0272477 | A1 | 10/2010 | Nishikawa | |
| 2011/0299882 | A1 * | 12/2011 | Tanaami et al. | 399/110 |
| 2013/0028632 | A1 | 1/2013 | Sato et al. | |

FOREIGN PATENT DOCUMENTS

| | | | |
|---|---|---|---|
| CN | 101512442 | A | 8/2009 |
| CN | 101846927 | A | 9/2010 |
| CN | 101866129 | A | 10/2010 |
| EP | 1821157 | A2 | 8/2007 |
| JP | 2008-026828 | | 2/2008 |
| JP | 2008-026830 | A | 2/2008 |
| JP | 2009-020375 | A | 1/2009 |
| JP | 2009-288473 | | 12/2009 |
| JP | 2010-230899 | | 10/2010 |
| JP | 2011-145707 | A | 7/2011 |

OTHER PUBLICATIONS

CN Notification of First Office Action mailed Dec. 23, 2013, CN Appln. 201210091050.6, English translation.

Co-pending U.S. Appl. No. 13/423,320, filed Mar. 19, 2012.

Extended EP Search Report mailed Apr. 4, 2014 in EP Appln. 12159925.2.

Extended EP Search Report mailed Apr. 1, 2014 in EP Appln. 12159899.9.

Jul. 9, 2014—(CN) Notification of First Office Action—App 201210086261.0—Eng tran.

Jul. 24, 2014—(CN) Notification of the Second Office Action—App 201210091050.69—Eng tran.

Dec. 18, 2014—(CN) Notification of the Second Office Action—App 201210086261.0, Eng Tran.

Oct. 3, 2014—(US)—Non-Final Office Action—U.S. Appl. No. 14/480,221.

May 26, 2015—(JP) Office Action—App 2011-167116, Eng Tran.

Sep. 11, 2015—(US) Non-Final Office Action—U.S. Appl. No. 14/816,470.

* cited by examiner

IMAGE FORMING APPARATUS AND DEVELOPER CARTRIDGE

CROSS REFERENCE TO RELATED APPLICATION

This application claims priority from Japanese Patent Application No. 2011-167116 filed Jul. 29, 2011. The entire content of the priority application is incorporated herein by reference.

TECHNICAL FIELD

The present invention relates to an image-forming device employing an electrophotographic system and a developer cartridge.

BACKGROUND

One electrophotographic color printer known in the art is a tandem-type color laser printer. This printer has four photosensitive members and four developing rollers for supplying toner to respective photosensitive members, the photosensitive members and developing rollers provided respectively for the toner colors yellow, magenta, cyan, and black.

An example of this type of tandem color laser printer includes an image-forming unit having photosensitive members and developing rollers; and toner cartridges accommodating toner.

The image-forming unit in this type of printer is centrally disposed inside the printer, while the toner cartridges are detachably provided in a lateral section of the printer.

SUMMARY

However, the toner cartridges in the conventional printer described above are mounted in and removed from the lateral section of the printer (that is, a cartridge-accommodating section) in the axial direction of the photosensitive member. Consequently, the printer must be installed such that a large space is available on the side of the printer for mounting and removing the toner cartridges. Hence, this configuration can make it difficult to install the printer in a small space (i.e., the structure is not conducive to reducing the required installation space of the printer).

This printer configuration is also not conducive to installation on shelves and in other locations with limited space above and to the side of the printer, thereby reducing the user's options for locations in which the printer can be installed.

Therefore, it is an object of the present invention to provide an image-forming apparatus provided with developer cartridge that can reduce the required installation space and increase the user's freedom in choosing locations for installing the device.

In order to attain the above and other objects, there is provided an image forming apparatus including a main casing, a plurality of image forming units, a plurality of developer cartridges, a support member, and a moving mechanism. The image forming units are juxtaposedly arrayed with each other in a predetermined direction. Each of the plurality of image forming units includes a photosensitive drum, a developer carrying member disposed in confrontation with the photosensitive drum, and a reception opening configured to receive developer. Each of the plurality of photosensitive drums has an axis extending in an axial direction perpendicular to the predetermined direction. The developer cartridges are configured to be juxtaposedly arrayed with each other in the predetermined direction. Each of the plurality of developer cartridges is configured to be provided for each of the plurality of image forming units. Each of the plurality of developer cartridges is configured to be disposed in confrontation with a corresponding one of the plurality of image forming units in the axial direction. Each of the plurality of developer cartridges includes a developer accommodating section configured to accommodate developer and a supply member having a supply opening through which developer in the developer accommodating section is configured to be supplied to a corresponding one of the plurality of image forming units. The support member is configured to detachably support each of the plurality of developer cartridges and is configured to be moved in the predetermined direction between a mounted position in which the support member is mounted in the main casing and a pulled-out position in which the support member is pulled out of the main casing. The moving mechanism is configured to move the supply member between a communication position and an interrupt position when the support member is in the mounted position. When the supply member is in the communication position, the supply opening and the reception opening are in communication with each other and the support member is incapable of moving in the predetermined direction. When the supply member is in the interrupt position, the supply member is moved away from the corresponding one of the plurality of image forming units in the axial direction to interrupt communication between the supply opening and the reception opening and the support member is movable toward the pulled-out position in the predetermined direction.

According to another aspect, there is provided a developer cartridge including a developer accommodating section and a supply member. The developer accommodating section is configured to accommodate developer and has a developer discharge opening. The supply member includes a developer reception opening and is configured to be connected to the developer accommodating section from below to receive developer through the developer reception opening and to convey the received developer in a horizontal direction. The supply member is configured to be moved in the horizontal direction between an open position in which the developer discharge opening and the developer reception opening are in communication with each other and a closed position in which the developer discharge opening is closed by interrupting communication between the developer discharge opening and the developer receiving opening.

According to another aspect, there is provided a developer cartridge including a developer accommodating section, and a supply member. The developer accommodating section is configured to accommodate developer and has a first opening. The supply member includes a second opening and a conveying member configured to convey developer, and is configured to be connected to the developer accommodating section. The supply member is configured to be moved relative the developer accommodating section between an open position in which the first opening and the second opening are in communication with each other and a closed position in which the first opening is closed by interrupting communication between the first opening and the second opening.

DETAILED DESCRIPTION

1. Overall Structure of a Printer

Figure 1:
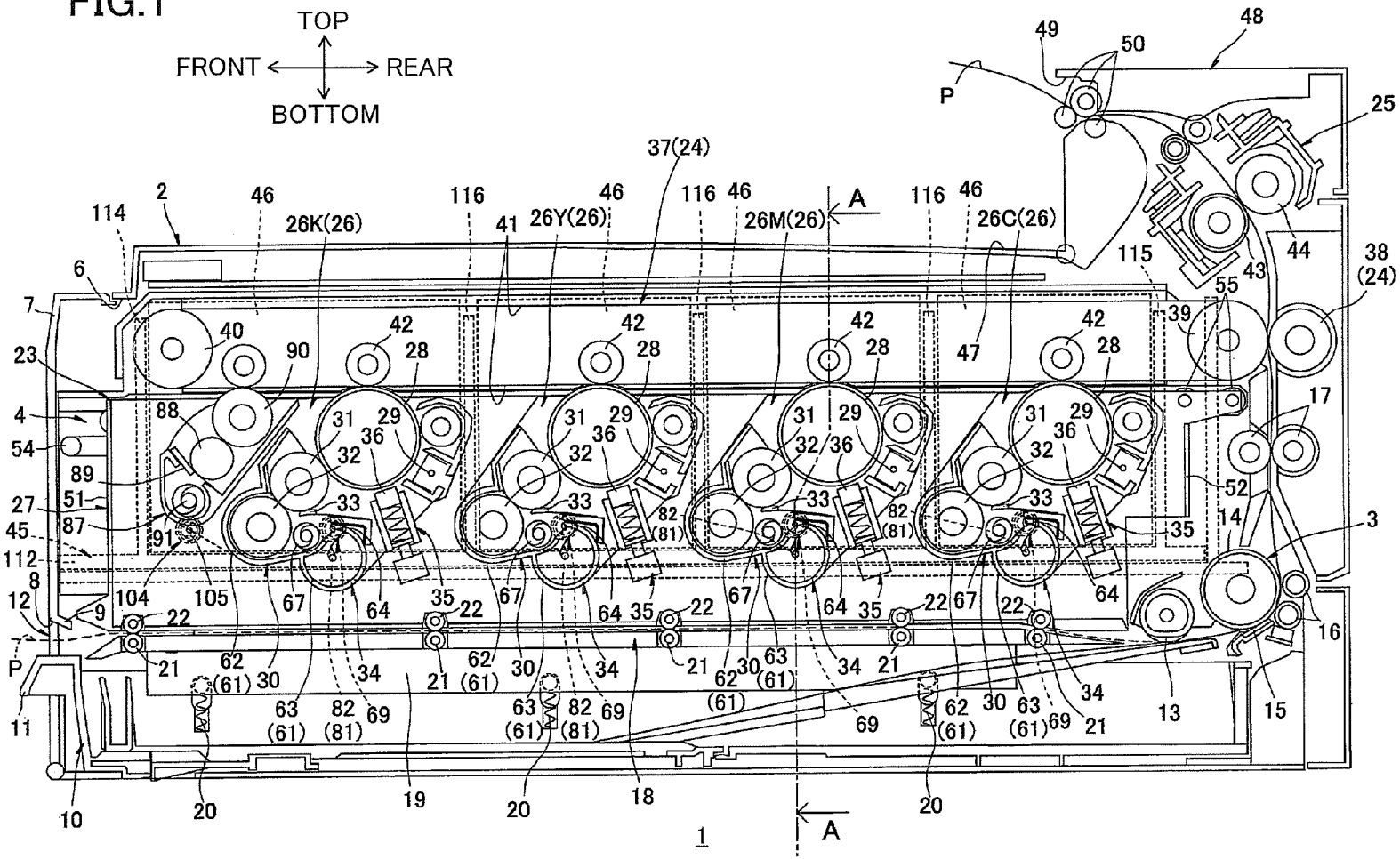
FIG. 1 is a cross-sectional view of a color printer according to an embodiment of the present invention.
Figure 2:
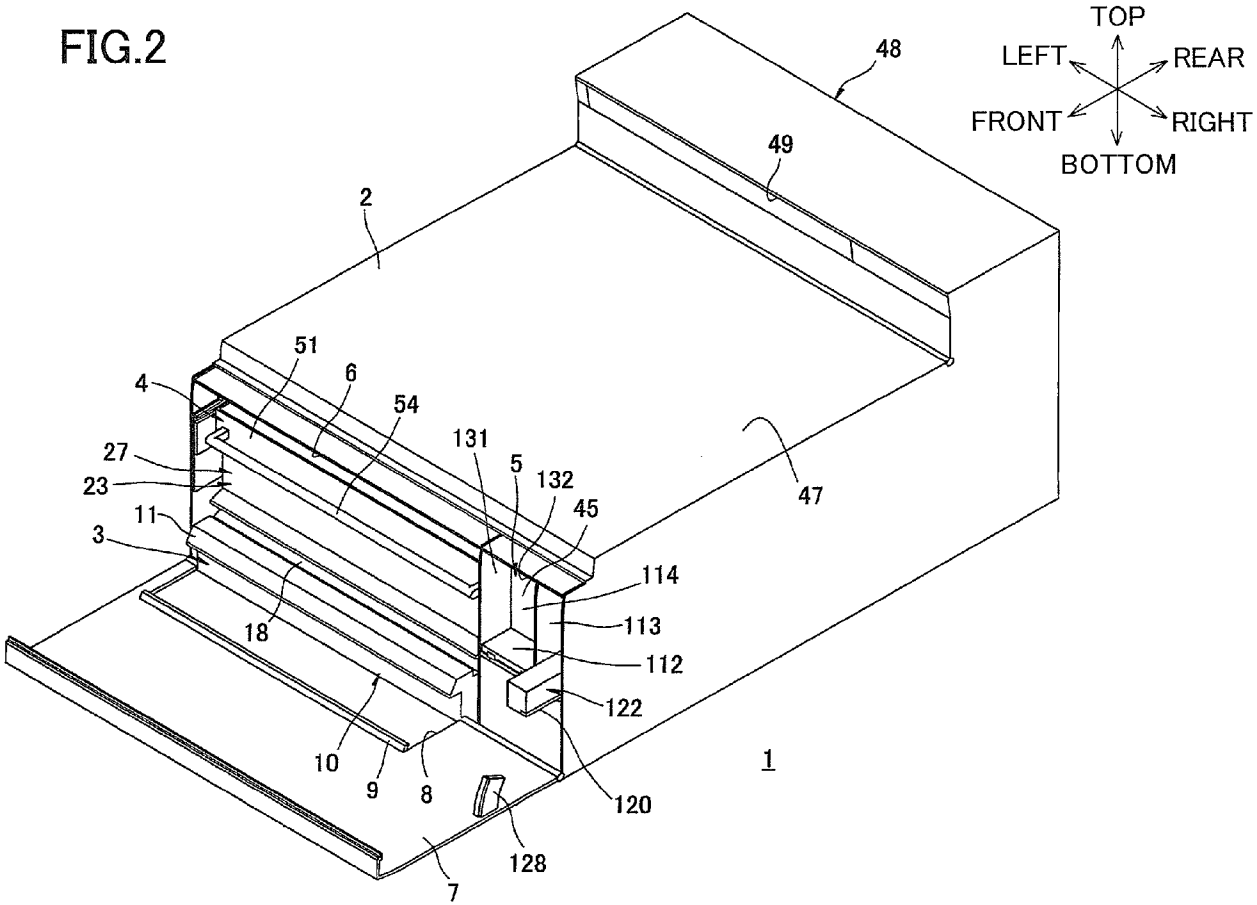
FIG. 2 is a perspective view of the color printer in FIG. 1, wherein a front cover is opened.

FIGS. 1 and 2 show a printer 1 serving as an example of the image-forming apparatus of the present invention. The printer 1 is an intermediate transfer tandem-type color printer.

The printer 1 includes a main casing 2 constituting the device body, a sheet-feeding unit 3 for feeding sheets of a paper P to be printed. An image-forming unit 4 for forming images on the paper P supplied by the sheet-feeding unit 3, and a toner-cartridge-accommodating section 5 for accommodating toner cartridges 46 (described later).

(1) Main Casing

The main casing 2 has a substantially rectangular box shape in a side view. A process-side access opening 6 is formed in a side wall of the main casing 2. A front cover 7 as an opening/closing member is pivotably (movably) disposed on the same side wall of the main casing 2. The front cover 7 is capable of pivoting about its lower end between a closed position for closing the process-side access opening 6 and an open position for exposing the process-side access opening 6.

An opening 8 that exposes the front end portion of a paper tray 10 (described later) is formed in a lower portion of the front cover 7. A manual-paper-feed guide 9 provided on the front cover 7 extends obliquely rearward and downward from the upper edge of the opening 8 toward a position between the bottom wall of a process frame 27 (described later) and the front end portion of a paper-feeding member 18 (described later).

In the following description, the side of the main casing 2 on which the front cover 7 is provided (the left side in FIG. 1) will be called the "front side," and the opposite side (the right side in FIG. 1) will be called the "rear side." Further, the left and right sides of the main casing 2 will be based on the perspective of a user facing the front side of the printer 1. In other words, the near side in FIG. 1 will be the "right side," while the far side will be the "left side."

(2) Sheet-Feeding Unit

The sheet-feeding unit 3 includes a paper tray 10 for accommodating sheets of paper P.

The paper tray 10 is removably mounted in the bottom section of the main casing 2. A grip part 11 is provided on the front wall of the paper tray 10 near the top edge thereof. The grip part 11 has a general U-shape in cross section, with the opening of the U-shape facing downward. The top surface of the grip part 11 vertically opposes the manual-paper-feed guide 9, with a gap formed therebetween. The gap formed between the top surface of the grip part 11 and the manual-paper-feed guide 9 defines a manual-paper-feed opening 12 through which sheets of paper P other than those accommodated in the paper tray 10 may be hand-fed.

The sheet-feeding unit 3 also includes a pick-up roller 13 disposed above the rear end of the paper tray 10, a feeding roller 14 disposed to the rear of the pick-up roller 13, a feeding pad 15 disposed so as to confront the feeding roller 14 from the bottom side thereof, a pair of top and bottom pinch rollers 16 disposed in contact with the rear side of the feeding roller 14, and a pair of registration rollers 17 disposed above the feeding roller 14 and opposing each other in the front-to-rear direction.

The pick-up roller 13 rotates to supply sheets of paper P accommodated in the paper tray 10 (indicated by a solid line in FIG. 1) between the feeding roller 14 and feeding pad 15, whereby the rotation of the feeding roller 14 separates and feeds the paper one sheet at a time. The rotating feeding roller 14 subsequently supplies each sheet of paper P so as to pass sequentially between the feeding roller 14 and pinch rollers 16 and enter between the registration rollers 17 disposed above the feeding roller 14. The registration rollers 17 rotate in order to supply the sheets to the image-forming unit 4 (between an intermediate transfer belt 41 and a secondary transfer roller 38, both described later) at a prescribed timing. This feed path extending from the paper tray 10 to the image forming unit 4 through the pick-up roller 13, the feeding roller 14, the feeding pad 15, the pair of pinch rollers 16, and the pair of registration rollers corresponds to a first feed path.

A manual-paper-feed path corresponding to second feed path is formed in the sheet-feeding unit 3 between the paper tray 10 and the bottom wall of a process frame 27 (described later).

A paper-feeding member 18 is provided in the paper tray 10. The paper-feeding member 18 constitutes the bottom wall of the manual-paper-feed path and confronts the bottom wall of a process frame 27 (described later).

The paper-feeding member 18 has a generally flat plate shape that is elongated in the front-to-rear direction. The paper-feeding member 18 is disposed on the upper edges of the paper tray 10 by means of a pair of left and right support plates 19 and various compression springs 20.

Five tray-side feeding members 21 are rotatably provided in the paper-feeding member 18 at intervals in the front-to-rear direction. While a process frame 27 will be described later, five process-side feeding members 22 are rotatably provided on the bottom wall of the process frame 27 at positions opposing the tray-side feeding members 21.

The paper P hand-fed through the manual-paper-feed opening 12 (indicated by a dashed line in FIG. 1) is guided by the manual-paper-feed guide 9 on the front cover 7 and the top surface of the grip part 11 provided on the paper tray 10 to a nip part between the forwardmost process-side feeding members 22 and the forwardmost tray-side feeding members 21. Each of the process-side feeding members 22 is driven to rotate while the corresponding tray-side feeding members 21 follow, conveying the hand-fed sheet in a rearward direction between the bottom surface of a process frame 27 (described later) and the top surface of the paper-feeding member 18.

The hand-fed sheets of paper P are guided to the pick-up roller 13 at the rear end of the paper-feeding member 18 and conveyed between the feeding roller 14 and feeding pad 15 by the rotation of the pick-up roller 13, as described above. The rotating feeding roller 14 then supplies the sheets of paper P sequentially through the feeding roller 14 and pinch rollers 16 to the nip part between the registration rollers 17 disposed above the feeding roller 14. The rotating registration rollers 17 supply the sheets between an intermediate transfer belt 41 and secondary transfer roller 38, both described later, at a prescribed timing. The manual-paper-feed path corresponds to a feed path extending from the manual-paper-feed opening 12 to the pick-up roller 13 through the tray-side feeding members 21 and the process-side feeding members 22.

(3) Image-Forming Unit

The image-forming unit 4 is disposed above the sheet-feeding unit 3 and includes a process unit 23, a transfer unit 24, and a fixing unit 25.

(3-1) Process Unit

The process unit 23 is movably disposed above the paper tray 10 in front of the pick-up roller 13. The process unit 23 is capable of moving in the front and rear directions between a mounted position in which the process unit 23 is mounted in the main casing 2 (see FIG. 1), and a pulled-out position in which the process unit 23 is pulled out of the main casing 2 (see FIG. 9).

The process unit 23 includes four process cartridges 26 as an image forming unit corresponding to the four colors used in image formation, and a process frame 27 for retaining the process cartridges 26 in a detachably mounted state.

The process cartridges 26 are juxtaposedly arranged parallel to one another and spaced at intervals in the front-to-rear direction (a predetermined direction). More specifically, the process cartridges 26 include, in order from front to rear, a black process cartridge 26K, a yellow process cartridge 26Y, a magenta process cartridge 26M, and a cyan process cartridge 26C.

Each process cartridge 26 integrally holds a photosensitive drum 28, a Scorotron charger 29, and a developing device 30.

The photosensitive drum 28 has a generally cylindrical shape and is oriented with its axis aligned in the left-to-right direction.

The Scorotron charger 29 is disposed below and rearward of the corresponding photosensitive drum 28. The Scorotron charger 29 confronts but is separated from the photosensitive drum 28.

The developing device 30 is disposed below and forward of the corresponding photosensitive drum 28. The developing device 30 is provided with a developing roller 31 as a developer carrying member.

The developing roller 31 is rotatably supported in the top of the developing device 30 and is disposed in confrontation with the photosensitive drum 28. A portion of the surface of the developing roller 31 is exposed when viewed from above the developing device 30 (obliquely above and rearward of the developing device 30) and contacts the photosensitive drum 28 on the lower front side.

Each developing device 30 also includes a supply roller 32 for supplying toner to the developing roller 31, and a thickness-regulating blade 33 for regulating the thickness of toner carried on the developing roller 31. Each developing device 30 also includes a toner reservoir 34 disposed below and rearward of the supply roller 32 for storing toner supplied from a toner cartridge 46 (described later).

The black process cartridge 26K also includes a belt-cleaning roller 90, a waste toner reservoir 87, a relay roller 88, and a scraping blade 89.

The belt-cleaning roller 90 is rotatably supported in the black process cartridge 26K in front of the corresponding photosensitive drum 28 and is positioned for contacting the lower portion of an intermediate transfer belt 41 (described later) from below.

The belt-cleaning roller 90 functions to clean off any toner remaining on the surface of the intermediate transfer belt 41 (described later). The relay roller 88 temporarily retains toner cleaned off by the belt-cleaning roller 90. The toner is subsequently scraped off the relay roller 88 by the scraping blade 89 and is collected in the waste toner reservoir 87.

An auger screw 91 is rotatably provided in the waste toner reservoir 87 of the black process cartridge 26K. The auger screw 91 conveys waste toner collected in the waste toner reservoir 87 to a waste-toner-collecting unit (not shown) provided in the black toner cartridge 46 (described later).

The process frame 27 provided in the main casing 2 is capable of sliding in forward and rearward directions. The process frame 27 includes four LED units 35 corresponding to the four photosensitive drums 28.

Each LED unit 35 is disposed on the rear side of the corresponding developing device 30 so as to face the bottom of the corresponding photosensitive drum 28. Each LED unit 35 also includes an LED array 36 having a plurality of LEDs arrayed in the left-to-right direction. The LED unit 35 functions to expose the surface of the corresponding photosensitive drum 28 based on prescribed image data.

(3-2) Transfer Unit

The transfer unit 24 includes a belt unit 37, and a secondary transfer roller 38.

The belt unit 37 is positioned above the process unit 23 when the process unit 23 is in the mounted position. The belt unit 37 is oriented in the front-to-rear direction so as to confront each of the photosensitive drums 28 from above.

The belt unit 37 includes a drive roller 39, a follow roller 40, an intermediate transfer belt 41, and four primary transfer rollers 42.

The drive roller 39 and follow roller 40 are separated in the front-to-rear direction.

The intermediate transfer belt 41 is placed around the drive roller 39 and follow roller 40 such that its lower portion contacts each of the photosensitive drums 28. When the drive roller 39 is driven to rotate, the intermediate transfer belt 41 circulates such that the lower portion of the intermediate transfer belt 41 that contacts each of the photosensitive drums 28 moves in a rearward direction.

The primary transfer rollers 42 are disposed so as to confront the corresponding photosensitive drums 28 with the lower portion of the intermediate transfer belt 41 interposed therebetween.

The secondary transfer roller 38 is provided on the rear side of the belt unit 37 and confronts the drive roller 39 of the belt unit 37 with the intermediate transfer belt 41 interposed therebetween.

(3-3) Fixing Unit

The fixing unit 25 is disposed above the secondary transfer roller 38. The fixing unit 25 includes a heating roller 43, and a pressure roller 44 that confronts the heating roller 43.

(4) Toner-Cartridge-Accommodating Section

Figure 3:
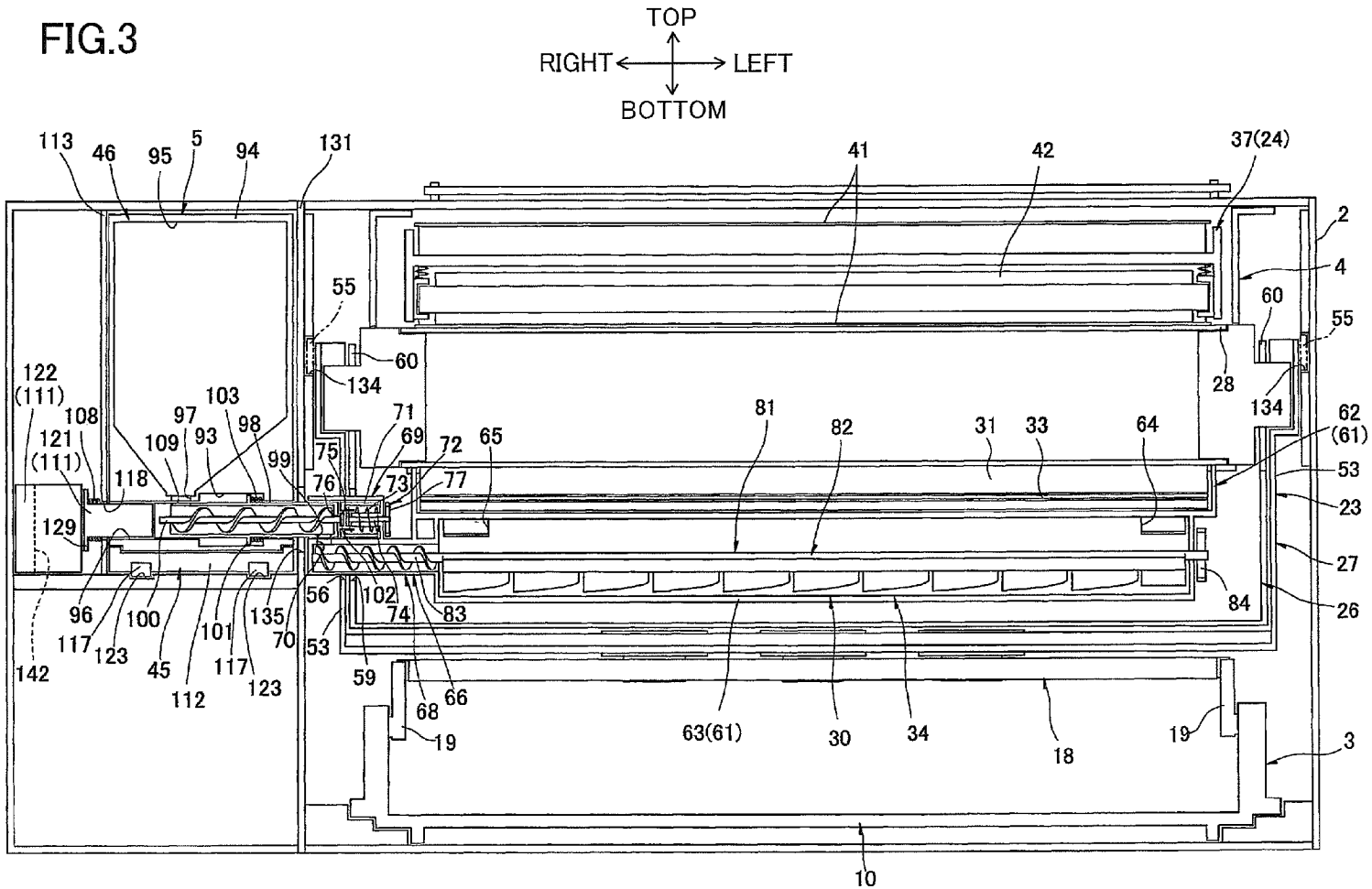
FIG. 3 is a cross-sectional view of the color printer taken along a line A-A of FIG. 1, wherein a supply cylinder is in an advanced position.

As shown in FIGS. 2 and 3, the toner-cartridge-accommodating section 5 is provided on the right side of the process unit 23. A cartridge-side access opening 132 as an opening is formed in the front end of the toner-cartridge-accommodating section 5 adjacent to the process-side access opening 6 on the right thereof. The cartridge-side access opening 132 is exposed simultaneously with the process-side access opening 6 when the front cover 7 is opened. A toner cartridge drawer 45 as a support member is accommodated in the toner-cartridge-accommodating section 5.

The toner cartridge drawer 45 integrally supports four toner cartridges 46 as a developer cartridge that each accommodates toner (developer) of a discrete color.

The toner cartridge drawer 45 is arranged in a front-to-rear orientation so as to confront all process cartridges 26. The toner cartridge drawer 45 is capable of moving between a mounted position in which the process cartridge 26 is mounted inside the main casing 2 (see FIG. 2), and a pulled-out position in which the process cartridge 26 is pulled outside the main casing 2 (see FIG. 8).

As will be described later in greater detail, when the toner cartridge drawer 45 is in the mounted position, each of the toner cartridges 46 is arranged in a position opposing the right side of the corresponding process cartridge 26. Each of the toner cartridges 46 is coupled to the right side of the corresponding process cartridge 26 and can supply toner into the toner reservoir 34 of the process cartridge 26.

(5) Image-Forming Operation

Toner supplied into the toner reservoir 34 of the process cartridge 26 from the corresponding toner cartridge 46 is supplied from the toner reservoir 34 onto the supply roller 32, and in turn supplied onto the developing roller 31.

The thickness-regulating blade 33 regulates the thickness of toner supplied to the developing roller 31 as the developing roller 31 rotates, maintaining the toner carried on the surface of the developing roller 31 at a thin uniform thickness. Further, toner supplied to the developing roller 31 is positively tribocharged between the thickness-regulating blade 33 and developing roller 31.

In the meantime, the Scorotron charger 29 applies a uniform positive charge to the surface of the corresponding photosensitive drum 28 as the photosensitive drum 28 rotates. The LED unit 35 subsequently exposes the charged surface of the photosensitive drum 28, forming an electrostatic latent image on the surface that corresponds to an image to be printed on paper P.

As the photosensitive drum 28 continues to rotate, the positively charged toner carried on the surface of the developing roller 31 is supplied to the latent image formed on the surface of the photosensitive drum 28. The toner develops the latent image on the photosensitive drum 28 into a visible toner image through reverse development.

The toner images developed on the surfaces of all photosensitive drums 28 are sequentially transferred onto the lower portion of the intermediate transfer belt 41, as the lower portion of the intermediate transfer belt 41 moves rearward, as a primary transfer. The sequentially transferred toner images form a color image on the intermediate transfer belt 41.

The color image carried on the intermediate transfer belt 41 is subsequently transferred onto a sheet of paper P supplied from the sheet-feeding unit 3, as the sheet passes between the intermediate transfer belt 41 and secondary transfer roller 38, as a secondary transfer.

Next, the color image transferred onto the paper P is fixed to the paper P in the fixing unit 25 by heat and pressure as the sheet passes between the heating roller 43 and pressure roller 44.

(6) Paper Discharge

A discharge tray 47 is formed on the top surface of the main casing 2 for receiving sheets of paper P discharged from the main casing 2. A paper-discharge unit 48 is formed on the top portion of the main casing 2 at the rear side thereof and protrudes farther upward than the discharge tray 47.

A discharge outlet 49 is formed in the paper-discharge unit 48 at a position above the discharge tray 47. Paper is discharged from the main casing 2 through the discharge outlet 49. The paper-discharge unit 48 also includes three discharge rollers 50 disposed inside the discharge outlet 49 for conveying sheets of paper P toward the discharge tray 47.

Hence, after a toner image is fixed to the sheet of paper P in the fixing unit 25, the discharge rollers 50 discharge the sheet onto the discharge tray 47.

2. Process Unit (1) Process Frame

Figure 4:
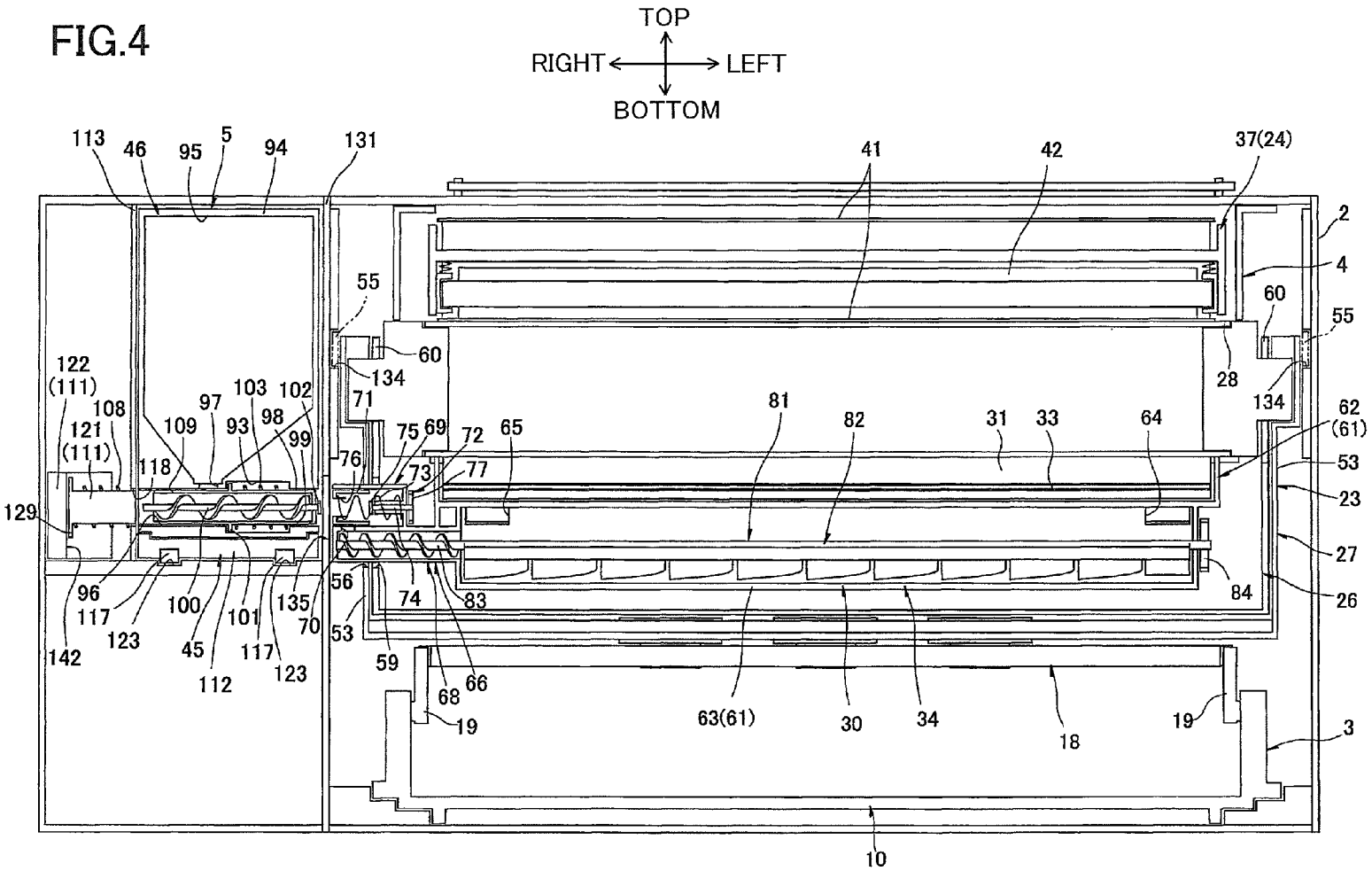
FIG. 4 is a cross-sectional view of the color printer taken along the line A-A of FIG. 1, wherein the supply cylinder is in a retracted position.

As shown in FIGS. 1, 3, and 4, the process frame 27 has a generally rectangular frame-like structure with a closed bottom and open top. More specifically, the process frame 27 includes a pair of side walls 53 arranged parallel to each other and separated in the left-to-right direction, a front wall 51 bridging the front ends of the side walls 53, and a rear wall 52 bridging the rear ends of the side walls 53.

The front wall 51 has a handle 54 protruding forward therefrom.

Guide rollers 55 are rotatably provided in the upper rear end of each of the side walls 53. Although not shown in the drawings, protrusions elongated in the front-to-rear direction and protruding outward in left and right directions from the left and right side walls 53 are provided on the top edges of the side walls 53.

An exposure groove 56 is formed in the right side wall 53 for exposing a toner-receiving unit 66 (described later) of the developing device 30. The exposure groove 56 is formed as a cutout in the top edge of the right side wall 53, producing a concave groove that is recessed toward the lower side of the right side wall 53 and that is open on the top.

(2) Process Cartridge

Each process cartridge 26 is provided with a pair of left and right side plates 60, the photosensitive drum 28, the Scorotron charger 29, and the developing device 30.

The side plates 60 are generally plate-shaped and elongated vertically. The side plates 60 are disposed parallel to each other and separated in the left-to-right direction. An exposure hole 59 is formed in the right side plate 60 to expose a toner-receiving unit 66 (described later).

The photosensitive drum 28 is rotatably supported between the side plates 60. The Scorotron charger 29 spans between the side plates 60.

The developing device 30 is provided between the side plates 60. The developing device 30 also has a developer case 61.

The developer case 61 is integrally provided with a first frame 62 that supports both the developing roller 31 and supply roller 32, and a second frame 63 that defines the toner reservoir 34.

The first frame 62 has a cylindrical shape elongated in the left-to-right direction. In cross section the first frame 62 has a U-shape with the opening of the "U" facing obliquely upward and rearward. An auger screw 67 is rotatably provided in the first frame 62 to the rear of the supply roller 32. A toner supply hole 64 and a toner recovery hole 65 are both formed in the bottom rear portion of the first frame 62 at positions confronting the rear side of the auger screw 67.

The toner supply hole 64 is a generally rectangular through-hole formed in the left end portion of the first frame 62. The toner recovery hole 65 is a through-hole having substantially the same shape and dimensions as the toner supply hole 64 and is formed in the right end portion of the first frame 62. The toner supply hole 64 and toner recovery hole 65 are aligned with each other in the left-to-right direction.

The second frame 63 is provided below the rear end of the first frame 62. The second frame 63 is formed in a partial cylindrical shape and is elongated in the left-to-right direction. A cross section of the second frame 63 is generally C-shaped, opening obliquely upward and forward. More specifically, the top of the second frame 63 is formed continuously with the lower rear portion of the first frame 62, forming a continuous peripheral edge above the toner supply hole 64 and toner recovery hole 65. The upper portion of the second frame 63 is also formed continuously with the lower rear portion of the first frame 62 in the region in front of and below the bottom edges of the toner supply hole 64 and toner recovery hole 65.

The developing device 30 is further provided with a toner-receiving unit 66 on the right side of the toner reservoir 34.

The toner-receiving unit 66 has a double-cylinder structure with two coupled cylinders arranged one above the other. The lower cylinder is a conveying cylinder 68, and the upper cylinder is a receiving cylinder 69.

The conveying cylinder 68 is formed continuously with the right wall of the second frame 63 and extends rightward therefrom. The conveying cylinder 68 has a generally cylindrical shape with a smaller diameter than that of the second frame 63 and has a common central axis with the second frame 63. The left end of the conveying cylinder 68 that is continuously formed with the right wall of the second frame 63 opens into the interior of the second frame 63, while the right end of the conveying cylinder 68 is closed.

A toner-conveying member 81 is provided inside the second frame 63 and conveying cylinder 68.

The toner-conveying member 81 is integrally provided with an agitator 82 disposed inside the second frame 63, and an auger screw 83 disposed inside the conveying cylinder 68. The agitator 82 and auger screw 83 are formed continuously in the left-to-right direction and share the same rotational shaft. The right end of the toner-conveying member 81 is rotatably supported in the right wall of the conveying cylinder 68. The left end of the toner-conveying member 81 is rotatably supported in the left wall of the second frame 63 so as to be capable of rotating relative to the left wall, and protrudes leftward therefrom. A drive gear 84 is provided on the left end portion of the toner-conveying member 81 outside the left wall of the second frame 63 and is incapable of rotating relative to the toner-conveying member 81. A drive force generated in the main casing 2 is inputted into the drive gear 84 via a gear train (not shown).

The receiving cylinder 69 is formed in a generally cylindrical shape that is elongated in the left-to-right direction. The lower portion of the receiving cylinder 69 is connected to the top portion of the conveying cylinder 68. The left end of the receiving cylinder 69 is closed and is disposed at a position confronting the right side of the first frame 62 at a distance. The right end of the receiving cylinder 69 is open. The inner diameter of the receiving cylinder 69 is slightly larger than the outer diameter of a supply cylinder 98 (described later) of the toner cartridge 46 and is capable of receiving this supply cylinder 98. A first reception opening 70 as a reception opening is formed in the right end portion of the receiving cylinder 69, vertically penetrating the bottom portion of the same, and provides communication between the conveying cylinder 68 and receiving cylinder 69.

The receiving cylinder 69 further includes a process-side shutter 71, and a coupling 72 as a first coupling member. The process-side shutter 71 is generally cylindrical in shape with a closed right end and is elongated in the left-to-right direction. The process-side shutter 71 has an outer diameter substantially equal to the outer diameter of the supply cylinder 98 (described later) and a left-to-right length equivalent to about half that of the receiving cylinder 69. A coupling exposure hole 76 is formed through the right wall of the process-side shutter 71 for exposing a fitting member 75 (described later) of the coupling 72. The coupling exposure hole 76 has a larger diameter than that of the fitting member 75 (described later).

The process-side shutter 71 is disposed inside the receiving cylinder 69 and is capable of sliding between an open position (see FIG. 3) in the left end of the receiving cylinder 69 for opening the first reception opening 70, and a closed position (see FIG. 4) in the right end of the receiving cylinder 69 for closing the first reception opening 70. A compression spring 73 is also interposed between the left wall of the receiving cylinder 69 and the right wall of the process-side shutter 71 for constantly urging the process-side shutter 71 rightward toward the closed position.

The coupling 72 is rotatably supported in the left wall of the receiving cylinder 69. The coupling 72 specifically includes a drive shaft 74, the fitting member 75, and a drive input gear 77.

The drive shaft 74 has a generally columnar shape and extends in the left-to-right direction. The drive shaft 74 is rotatably supported in the left wall of the receiving cylinder 69.

The fitting member 75 is provided on the right end of the drive shaft 74 and is incapable of rotating relative thereto. The fitting member 75 is generally disc-shaped and shares a central axis with the drive shaft 74.

The drive input gear 77 is provided on the left end of the drive shaft 74 and is incapable of rotating thereto. The drive input gear 77 is positioned between the receiving cylinder 69 and first frame 62 and shares a central axis with the drive shaft 74. A drive force generated from the main casing 2 is inputted into the drive input gear 77 via a gear train (not shown).

3. Toner Cartridges and Toner-Cartridge-Accommodating Section (1) Toner Cartridges As shown in FIGS. 3 and 4, each of the toner cartridges 46 includes a cartridge case 94 accommodating toner, and a supply cylinder 98 as a supply member for supplying toner in the cartridge case 94 to the toner reservoir 34 of the process cartridge 26.

The cartridge case 94 has a box shape that is generally rectangular in a side view. Within the cartridge case 94 are formed a toner-accommodating section 95 as a developer accommodating section for accommodating toner, and a supply-cylinder support unit 96 for supporting the supply cylinder 98.

The toner-accommodating section 95 is provided in all but the lower portion of the cartridge case 94. The lower end of the toner-accommodating section 95 is tapered so that its horizontal cross section grows smaller toward the bottom. A through-hole 97 as a developer discharge opening is formed in the bottom end of the toner-accommodating section 95, opening downward.

The supply-cylinder support unit 96 is formed in the lower end of the cartridge case 94 as a through-hole in communication with the through-hole 97. The supply-cylinder support unit 96 has a generally circular cross section and extends left-to-right. The inner diameter of the supply-cylinder support unit 96 is larger than the outer diameter of the supply cylinder 98.

A spring-accommodating section 93 is formed in the supply-cylinder support unit 96. The spring-accommodating section 93 is provided at a midpoint of the supply-cylinder support unit 96 with respect to the left-to-right direction (more specifically, left of the left-to-right center of the supply-cylinder support unit 96) on the left side of the through-hole 97. The spring-accommodating section 93 is generally circular in cross section and elongated in the left-to-right direction and has a larger diameter that expands radially outward from the inner diameter of the supply-cylinder support unit 96.

The supply cylinder 98 has a generally cylindrical shape and is elongated in the left-to-right direction and closed on both left and right ends. The supply cylinder 98 has a left-to-right length substantially equal to the left-to-right length of the cartridge case 94. A supply opening 99 is formed in the left end of the supply cylinder 98, penetrating the lower portion of the supply cylinder 98 vertically. Similarly, a second reception opening 109 as a developer reception opening is formed in the right end of the supply cylinder 98, penetrating the upper portion of the supply cylinder 98 vertically. A flange part 101 is provided around the supply cylinder 98 at approximately the left-to-right center thereof and protrudes radially outward from the outer peripheral surface of the supply cylinder 98.

The supply cylinder 98 is provided with an auger screw 100 as a conveying member. The auger screw 100 is disposed inside the supply cylinder 98 and oriented in the left-to-right direction (in a horizontal direction). The right end of the auger screw 100 is rotatably supported in the right wall of the supply cylinder 98, and the left end of the auger screw 100 is rotatably supported in the left wall of the supply cylinder 98 and protrudes leftward out from the left wall.

A fitting part 102 as a second coupling member and a drive input member is formed on the left end portion of the auger screw 100. The fitting part 102 is generally disc-shaped and shares a rotational center with the auger screw 100. The fitting part 102 is fitted with the fitting member 75 provided on the coupling 72 of the toner-receiving unit 66 so as to be incapable of rotating relative to the fitting member 75.

The supply cylinder 98 is supported inside the supply-cylinder support unit 96 of the cartridge case 94 so that the flange part 101 is positioned in the spring-accommodating section 93.

This configuration for supporting the supply cylinder 98 enables the supply cylinder 98 to move left and right between a retracted position as an interrupt position and a closed position (see FIG. 4) retracted inside the supply-cylinder support unit 96, and an advanced position as a communication position and an open position (see FIG. 3) advanced until the left end of the supply cylinder 98 is farther leftward than the left end of the supply-cylinder support unit 96.

When the supply cylinder 98 is in the retracted position, the flange part 101 is disposed in the right end of the spring-accommodating section 93 and the second receiving port 109 is shifted to the right side of the through-hole 97, interrupting communication between the second receiving port 109 and through-hole 97. Here, the through-hole 97 is closed from below by the upper edge of the supply cylinder 98 (the portion of the supply cylinder 98 on the left side of the second receiving port 109). Further, when the supply cylinder 98 is in the retracted position, the left and right end faces of the supply cylinder 98 are substantially flush with the left and right end faces of the cartridge case 94.

When the supply cylinder 98 is in the advanced position, the flange part 101 is disposed in the left end portion of the spring-accommodating section 93, and the second receiving port 109 and through-hole 97 are aligned vertically and in communication with each other.

A compression spring 103 as an urging member is interposed between the right surface of the flange part 101 and the left surface of the spring-accommodating section 93 for constantly urging the supply cylinder 98 rightward toward the retracted position. To be disposed in the advanced position, the supply cylinder 98 is moved leftward against the urging force of the compression spring 103.

As illustrated in FIG. 1, the black toner cartridge 46 is formed wider in the front-to-rear direction than the other toner cartridges 46 (cyan, magenta, and yellow toner cartridges 46). A waste-toner-accommodation section (not shown) is provided in the front region of the black toner cartridge 46 separately from the toner-accommodating section 95 for accommodating waste toner conveyed from the waste toner reservoir 87.

Figure 6:
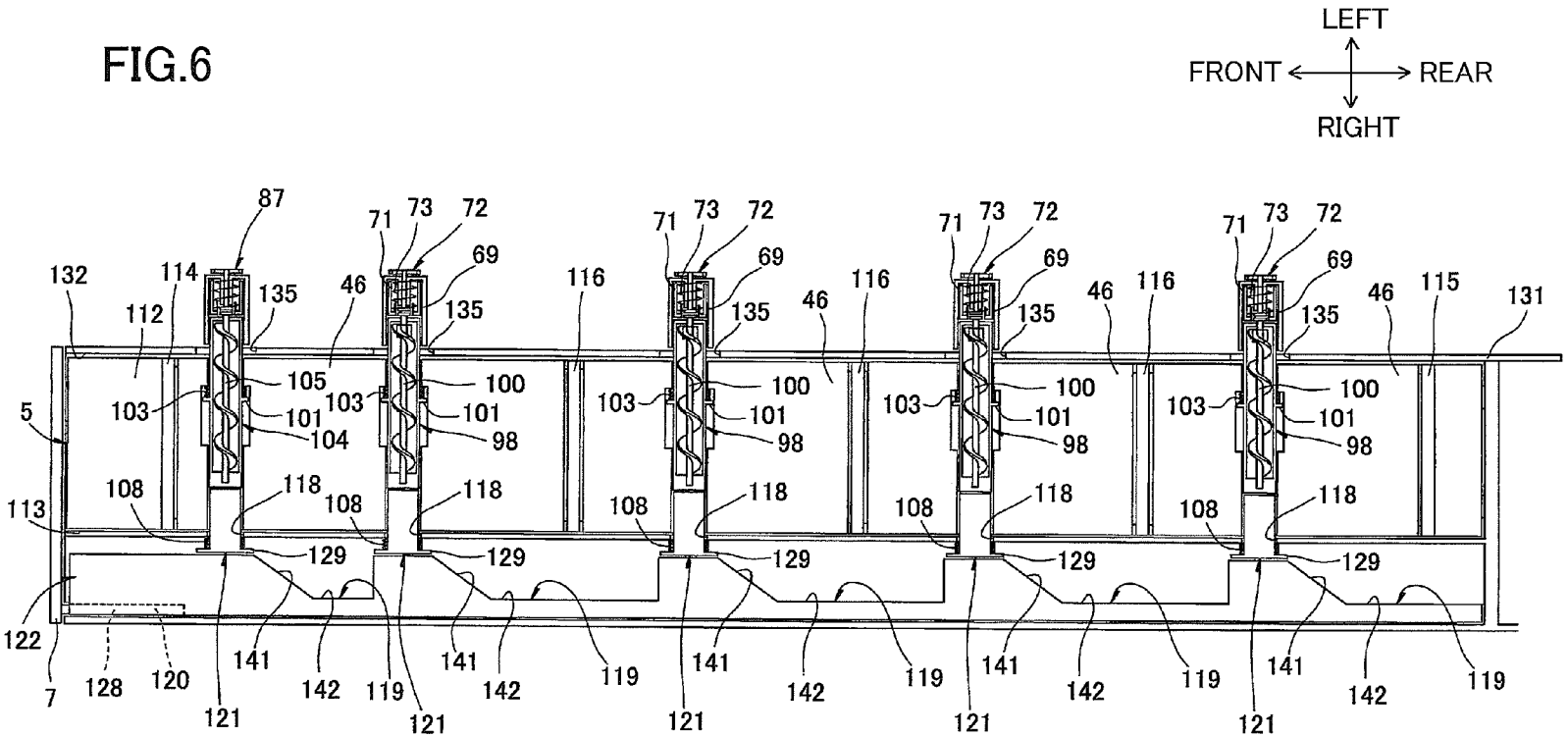
FIG. 6 is an explanatory diagram illustrating a movement of the supply cylinder in the toner-cartridge-accommodating section shown in FIG. 2, wherein the front cover is closed and the supply cylinder is in the advanced position.

As shown in FIG. 6, the black toner cartridge 46 includes a waste-toner-conveying cylinder 104 coupled to the waste toner reservoir 87 of the black process cartridge 26K.

The waste-toner-conveying cylinder 104 is shaped substantially the same as the supply cylinder 98. However, instead of the supply opening 99 formed in the left end of the supply cylinder 98, a waste-toner-receiving port (not shown) is provided in the waste-toner-conveying cylinder 104, vertically penetrating the upper portion thereof, for receiving waste toner from the waste toner reservoir 87.

When in the advanced position shown in FIG. 6, the waste-toner-conveying cylinder 104 is coupled to the waste toner reservoir 87 of the black process cartridge 26K. However, when the waste-toner-conveying cylinder 104 is in the retracted position shown in FIG. 7, the waste-toner-conveying cylinder 104 is disconnected from the waste toner reservoir 87.

(2) Toner-Cartridge-Accommodating Section

As shown in FIGS. 2, 3, and 4, a partitioning wall 113 divides the toner-cartridge-accommodating section 5 into left and right sides. The toner cartridge drawer 45 is accommodated in the left side, while a moving mechanism 111 is accommodated in the right side.

Five pressing-member insertion holes 118 (see FIG. 5) are formed in the lower end of the partitioning wall 113 for receiving the insertion of pressing members 121 (described later).

The pressing-member insertion holes 118 are juxtaposed at intervals in the front-to-rear direction and formed at positions corresponding to the supply cylinders 98 and the waste-toner-conveying cylinder 104.

(2-1) Toner Cartridge Drawer

As shown in FIG. 1, the toner cartridge drawer 45 has a frame-like structure that is elongated in the front-to-rear direction. The toner cartridge drawer 45 has a closed bottom but is open on the left and right sides. More specifically, the toner cartridge drawer 45 is integrally configured of a bottom wall 112, a front wall 114, a rear wall 115, and three partitioning walls 116.

The bottom wall 112 has a flat plate shape that is substantially rectangular in a plan view and elongated in the front-to-rear direction. Drawer-side rollers 117 are provided on the rear edge of the bottom wall 112 near both left and right sides thereof. The drawer-side rollers 117 are fitted with play in guide grooves 123 (described later) formed in the toner-cartridge-accommodating section 5.

The front wall 114 has a generally flat plate shape and extends upward from the front edge of the bottom wall 112. The rear wall 115 has a generally flat plate shape and extends upward from the rear edge of the bottom wall 112.

The partitioning walls 116 are arranged parallel to each other and spaced at intervals in the front-to-rear direction between the front wall 114 and rear wall 115. Each of the partitioning walls 116 has a generally flat plate shape and extends upward from the bottom wall 112. With this configuration, the toner cartridge drawer 45 is partitioned into four regions each having a front-to-rear length equivalent to the front-to-rear length of the corresponding toner cartridge 46.

Each of the toner cartridges 46 is detachably supported in the toner cartridge drawer 45 in areas defined by the front wall 114, rear wall 115, and partitioning walls 116.

Figure 5:
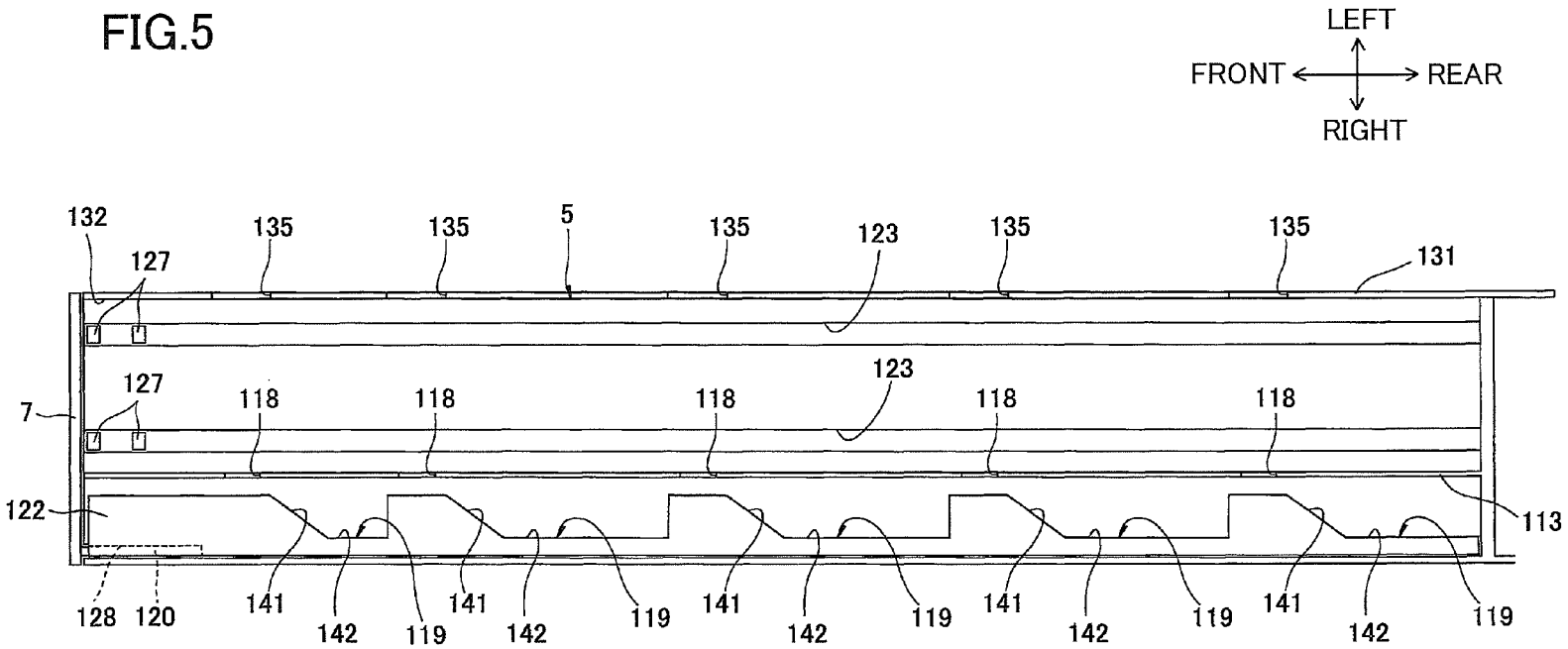
FIG. 5 is an explanatory diagram illustrating a toner-cartridge-accommodating section shown in FIG. 2 and is a plan view showing a translation cam and guide grooves.

As shown in FIG. 5, guide grooves 123 are formed in the bottom portion of the toner-cartridge-accommodating section 5 for receiving the drawer-side rollers 117 of the toner cartridge drawer 45. Rail-side rollers 127 are also provided in the bottom portion of the toner-cartridge-accommodating section 5.

Two of the guide grooves 123 are formed in the left half portion of the toner-cartridge-accommodating section 5 at positions separated in the left-to-right direction and corresponding to the drawer-side rollers 117 of the toner cartridge drawer 45. The guide grooves 123 are grooves recessed downward into the bottom surface of the toner-cartridge-accommodating section 5 and are substantially linear, extending in the front-to-rear direction.

The rail-side rollers 127 are rotatably provided in the front ends of the guide grooves 123 such that their top portions protrude upward from the guide grooves 123.

The toner cartridge drawer 45 is accommodated in the toner-cartridge-accommodating section 5 with the drawer-side rollers 117 fitted into the corresponding guide grooves 123. The rail-side rollers 127 contact the bottom of the bottom wall 112 constituting the toner cartridge drawer 45.

(2-2) Moving Mechanism

Figure 7:
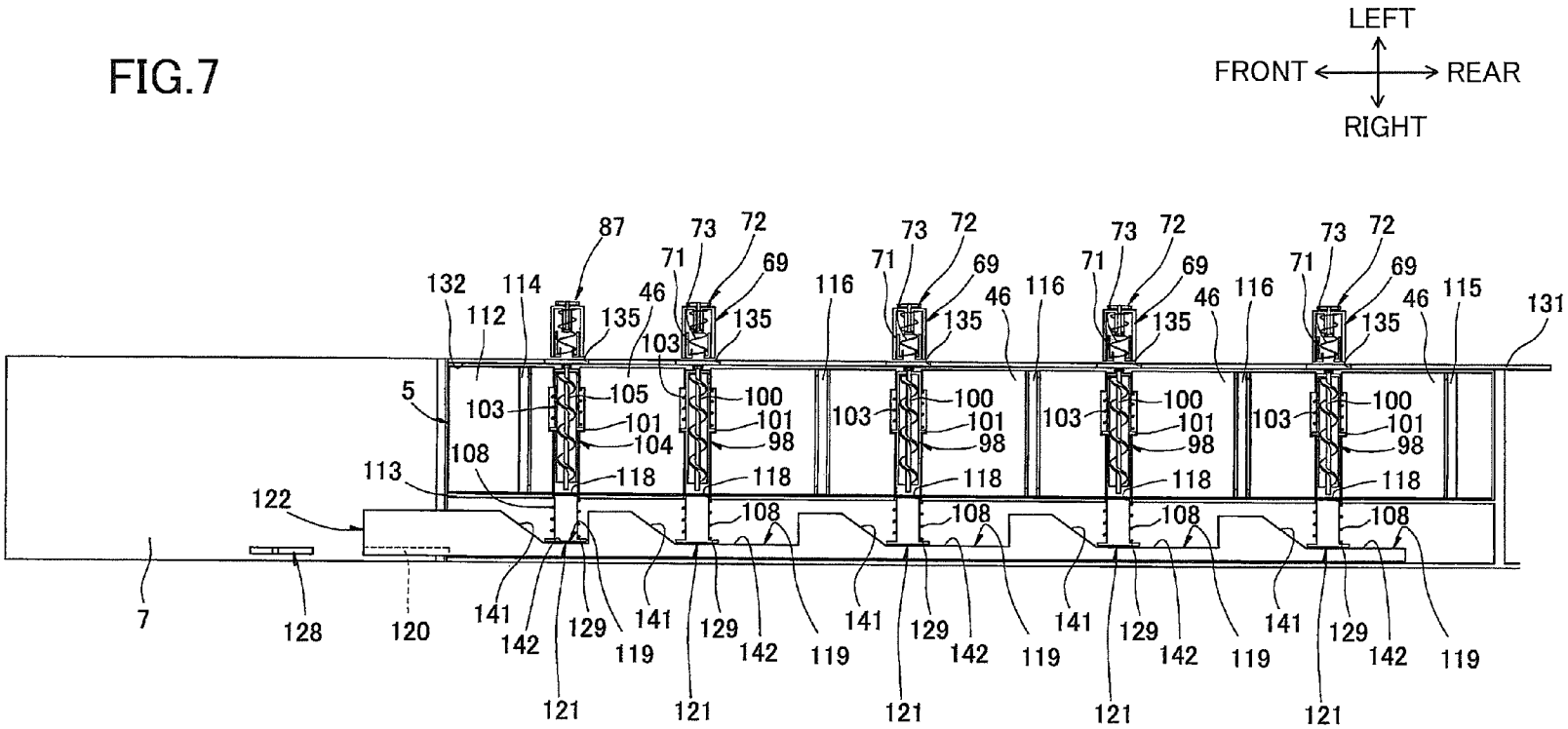
FIG. 7 is an explanatory diagram illustrating the movement of the supply cylinder in the toner-cartridge-accommodating section shown in FIG. 2, wherein the front cover is opened and the supply cylinder is in the retracted position.

As shown in FIGS. 2, 6, and 7, the moving mechanism 111 is provided with a translation cam 122 as a moving member, and five pressing members 121. The moving member 111 is disposed on an opposite side of the supply cylinder 98 from the process cartridges 26.

The translation cam 122 is provided in the right half of the toner-cartridge-accommodating section 5 and is capable of sliding (reciprocating) in forward and rearward directions. The translation cam 122 has a square columnar shape extending in the front-to-rear direction and is substantially rectangular in a plan view.

The translation cam 122 includes four recessed parts 119 corresponding to the supply cylinders 98 and the waste-toner-conveying cylinder 104, and a rack part 120 as an operating portion.

The recessed parts 119 are aligned with each other and spaced at intervals in the front-to-rear direction. Each recessed part 119 has a generally trapezoidal shape in a plan view and is recessed rightward in the left surface of the translation cam 122. Each recessed part 119 has a front surface 141 sloping rightward toward the rear, and a right surface 142 aligned in the front-to-rear direction and formed continuously from the rear end of the front surface 141. The forwardmost recessed part 119 corresponding to the waste-toner-conveying cylinder 104 has a front-to-rear length approximately half that of the other recessed parts 119.

The rack part 120 extends in the front-to-rear direction and is formed on the left side of the translation cam 122 along the bottom edge near the front end thereof. Gear teeth (not shown) are formed in the bottom edge of the rack part 120.

The translation cam 122 is provided in the toner-cartridge-accommodating section 5 and is capable of sliding (reciprocating) between a first position (see FIG. 6) accommodated in the toner-cartridge-accommodating section 5, and a second position (see FIG. 7) in which the front end portion of the translation cam 122 protrudes forward from the cartridge-side access opening 132.

When the translation cam 122 is in the first position, each of the recessed parts 119 is offset rearward from the corresponding pressing-member insertion holes 118. When the translation cam 122 is in the second position, the recessed parts 119 are disposed opposite the corresponding pressing-member insertion holes 118.

A coupling member 128 is provided on the front cover 7. By engaging the coupling member 128 with the rack part 120, the translation cam 122 is coupled to the front cover 7.

More specifically, the coupling member 128 has a generally curved rod shape. When the front cover 7 is in the closed position, the coupling member 128 extends from the rear surface of the front cover 7, curving downward and rearward. Gear teeth (not shown) are formed on the top surface of the coupling member 128. When the front cover 7 is in the closed position, the coupling member 128 engages with the rack part 120 from below.

When the front cover 7 is moved from the closed position to the open position, a forward drive force is transmitted to the translation cam 122 via the coupling member 128 for moving the translation cam 122 from the first position to the second position. As the front cover 7 moves further toward the open position, the coupling member 128 separates from the rack part 120 of the translation cam 122.

Conversely, as the front cover 7 is moved from the open position toward the closed position, the rear end (free end) of the coupling member 128 engages with the rear end of the rack part 120 provided on the translation cam 122. As the front cover 7 moves further toward the closed position, a rearward drive force is transmitted to the translation cam 122 via the coupling member 128 for moving the translation cam 122 from the second position to the first position.

The pressing members 121 are arranged at intervals on the left side of the translation cam 122 in positions corresponding to the supply cylinders 98 and the waste-toner-conveying cylinder 104. Each pressing member 121 has a generally columnar shape and extends in the left-to-right direction. The left-to-right length of the pressing members 121 is slightly longer than the gap between the right surface 142 of the recessed parts 119 formed in the translation cam 122 and the right surface of the partitioning wall 113. A flange part 129 is provided on the right end of each pressing member 121. The flange part 129 protrudes radially outward from the outer surface of the pressing member 121.

Each pressing member 121 can be moved between a pressing position (see FIG. 6) in which the pressing member 121 is inserted into the corresponding pressing-member insertion hole 118 and presses the corresponding supply cylinder 98 or waste-toner-conveying cylinder 104 leftward, and a release position (see FIG. 7) in which the pressing member 121 is retracted to the right side of the corresponding pressing-member insertion hole 118, releasing pressure on the corresponding supply cylinder 98 or waste-toner-conveying cylinder 104.

A compression spring 108 is interposed between the left surface of each flange part 129 and the right surface of the partitioning wall 113. The compression springs 108 constantly urge the corresponding pressing members 121 rightward toward the release position.

When the translation cam 122 is in the first position, the right end of each pressing member 121 contacts the left surface of the translation cam 122 on the front side of the corresponding recessed part 119. In this state, each pressing member 121 has been moved leftward against the urging force of the compression spring 108 and is in the pressing position shown in FIG. 6.

When the translation cam 122 is disposed in the second position, the right end of each pressing member 121 opposes the right surface 142 of the corresponding recessed part 119. In this state, the pressing member 121 has been moved rightward by the urging force of the compression spring 108 and is in the release position shown in FIG. 7.

4. Main Casing

Figure 9:
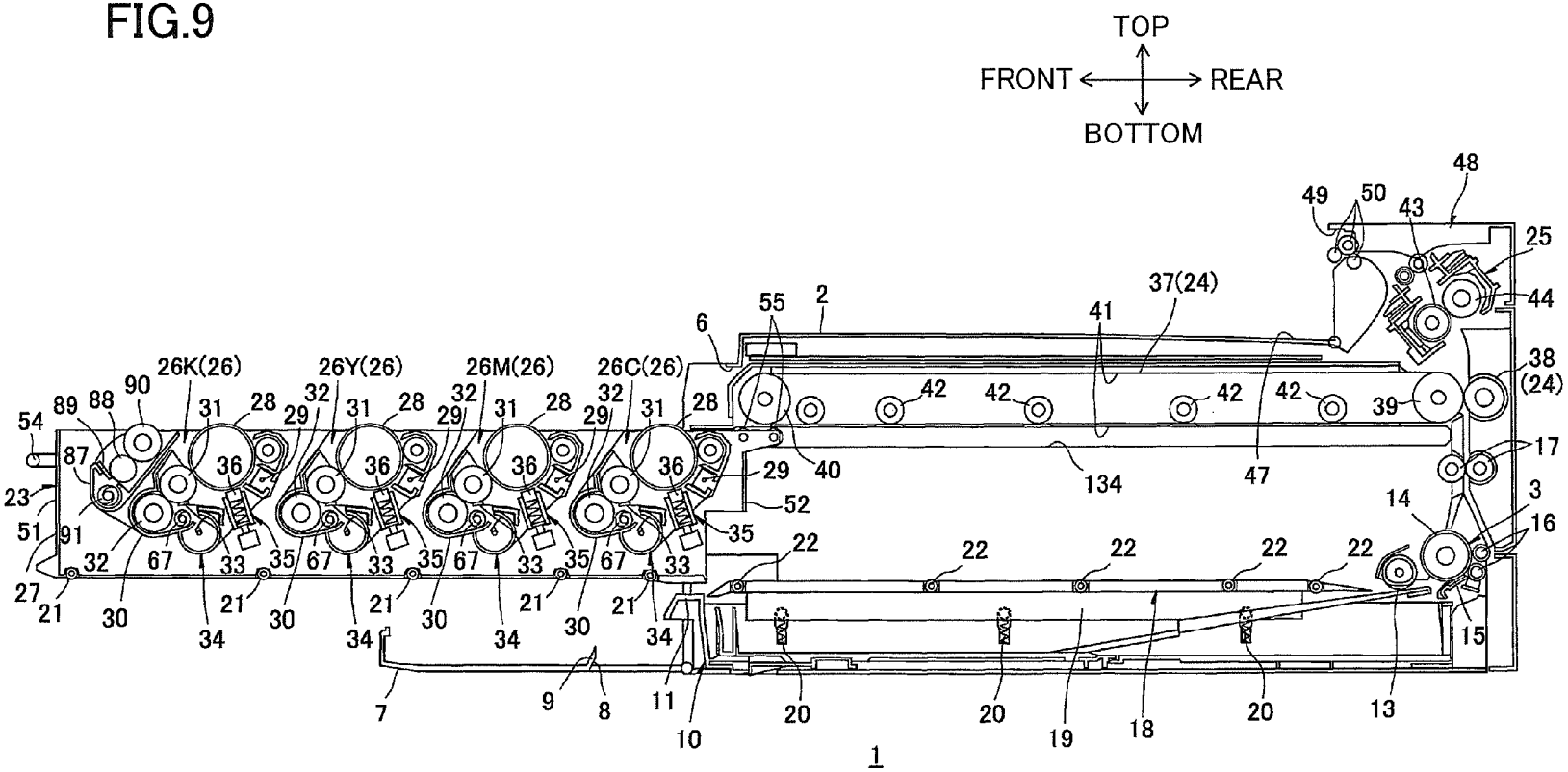
FIG. 9 is an explanatory diagram illustrating the removal and mounting process cartridges shown in FIG. 1.

As shown in FIGS. 3, 6, and 9, a partitioning wall 131 is provided in the main casing 2 for separating the image-forming unit 4 and toner-cartridge-accommodating section 5. Process-unit guide grooves 134 are formed in the main casing 2 for guiding the process unit 23 as the process unit 23 slides.

The partitioning wall 131 has a general flat plate shape. The partitioning wall 131 is disposed between the image-forming unit 4 and toner-cartridge-accommodating section 5. Five through-holes 135 are formed in the partitioning wall 131 to allow insertion of the four supply cylinders 98 of the toner cartridges 46 and the waste-toner-conveying cylinder 104.

The through-holes 135 are substantially circular in a side view and are arranged at positions spaced in the front-to-rear direction that correspond to the supply cylinders 98 of the toner cartridges 46 and the waste-toner-conveying cylinder 104.

One of the process-unit guide grooves 134 is formed in the right surface of the left wall of the main casing 2 while the other is formed in the left surface of the partitioning wall 131. The process-unit guide grooves 134 extend in the front-to-rear direction and are substantially linear. The process-unit guide grooves 134 have a width (vertical dimension) sufficient to receive the guide rollers 55 of the process unit 23.

5. Operations for Mounting and Removing the Toner Cartridges

To remove the toner cartridges 46 mounted in the main casing 2, first the operator places the front cover 7 in the open position, as shown in FIG. 2, to expose the cartridge-side access opening 132.

When the front cover 7 is moved from the closed position to the open position, the translation cam 122 is pulled forward through the coupling member 128, moving the translation cam 122 from the first position shown in FIG. 6 to the second position shown in FIG. 7.

When the translation cam 122 is moved to the second position, the urging force of the compression springs 108 moves the corresponding pressing members 121 from their pressing position to their release position.

At the same time, the urging force of the compression springs 103 moves the corresponding supply cylinders 98 and the waste-toner-conveying cylinder 104 from their advanced position to their retracted position so that the supply cylinders 98 and the waste-toner-conveying cylinder 104 are extracted from the through-holes 135 of the partitioning wall 131, as shown in FIGS. 4 and 7. That is, the moving mechanism 111 moves the supply cylinders 98 of all toner cartridges 46 altogether between the advanced position to the retracted position at a time.

This retraction interrupts communication between the supply openings 99 of the supply cylinders 98 and the first reception openings 70 of the receiving cylinders 69 and also interrupts communication between the second receiving ports 109 of the supply cylinders 98 and the through-holes 97 of the toner-accommodating sections 95. In addition, the fitting parts 102 of the supply cylinders 98 are moved rightward and separated from the fitting members 75 of the corresponding receiving cylinders 69, and the waste-toner-conveying cylinder 104 is uncoupled from the waste toner reservoir 87.

At this time, the toner cartridge drawer 45 can be pulled forward.

Further, the process-side shutters 71 are moved to the closed position by the urging force of the corresponding compression springs 73 at this time.

Figure 8:
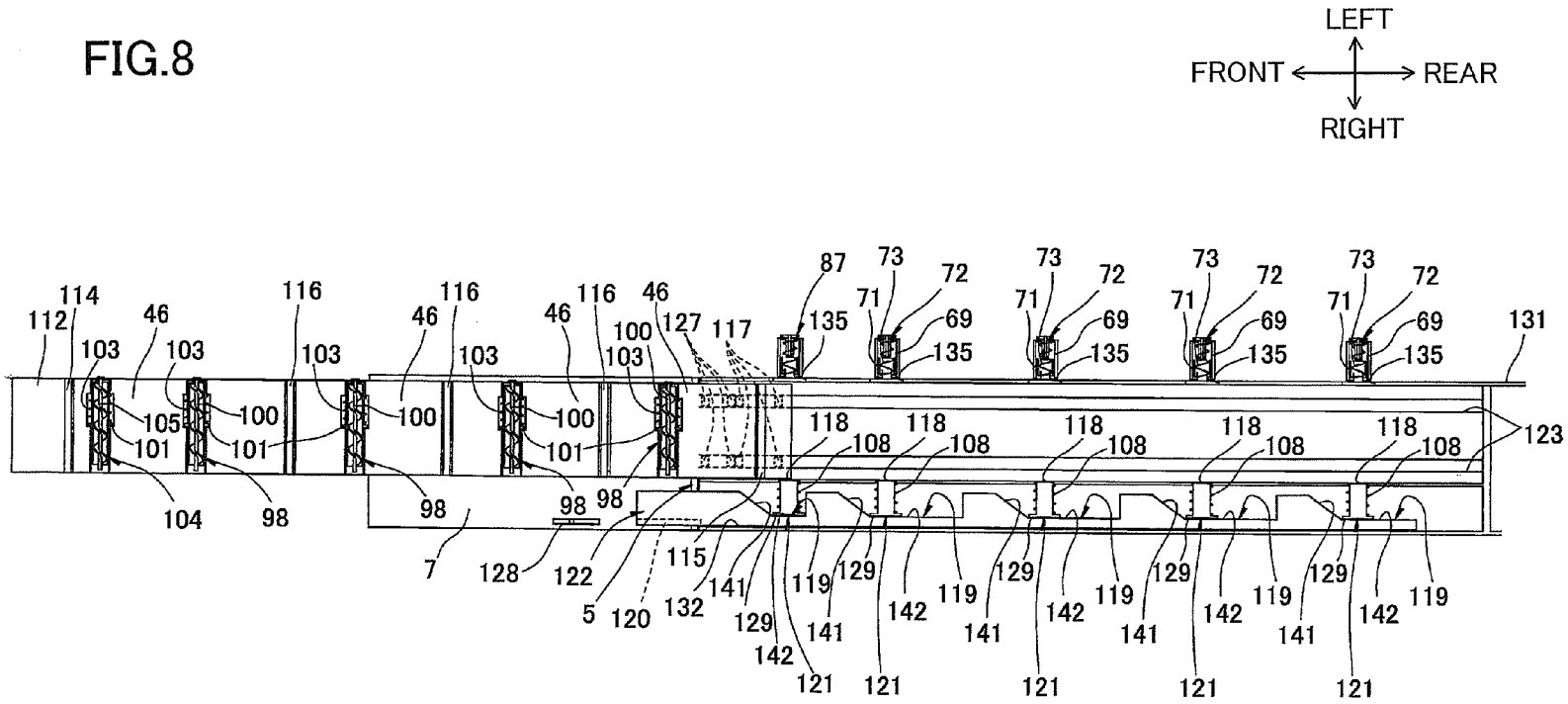
FIG. 8 is an explanatory diagram illustrating the toner-cartridge-accommodating section shown in FIG. 2, wherein a toner cartridge drawer is in a pulled-out position.

To move the toner cartridges 46, the operator pulls the toner cartridge drawer 45 forward through the cartridge-side access opening 132. When the toner cartridge drawer 45 reaches the pulled-out position, the drawer-side rollers 117 contact the rear side of the rail-side rollers 127, as shown in FIG. 8. This contact between the rail-side rollers 127 and the drawer-side rollers 117 restricts the toner cartridge drawer 45 from being pulled farther.

To remove the toner cartridges 46, the operator lifts the toner cartridges 46 up and out of the toner cartridge drawer 45. This completes the operation to remove toner cartridges 46 from the main casing 2.

In order to mount toner cartridges 46 in the main casing 2, the procedure described above for removing the toner cartridges 46 is performed in reverse.

Specifically, while the toner cartridge drawer 45 is disposed in the pulled-out position, the operator inserts the toner cartridges 46 into the toner cartridge drawer 45 from above to a prescribed position within the toner cartridge drawer 45.

To mount the toner cartridges 46 in the main casing 2, the operator then pushes the toner cartridge drawer 45 rearward through the cartridge-side access opening 132. As the toner cartridge drawer 45 is pushed rearward, the rear end of the toner cartridge drawer 45 contacts the rear wall of the toner-cartridge-accommodating section 5, as shown in FIG. 7. At this time, the toner cartridge drawer 45 is in the mounted position.

In this position, the supply cylinders 98 of the toner cartridge 46 face the right sides of the receiving cylinders 69 in the corresponding process cartridges 26 through the through-holes 135 formed in the partitioning wall 131. The waste-toner-conveying cylinder 104 of the toner cartridge 46 confronts the right side of the waste toner reservoir 87 in the black process cartridge 26K through the through-hole 135 of the partitioning wall 131.

Next, the operator moves the front cover 7 to its closed position, thereby closing the cartridge-side access opening 132. As the front cover 7 moves from the open position to the closed position, the translation cam 122 is pushed rearward through the coupling member 128, moving the translation cam 122 from the second position shown in FIG. 7 to the first position shown in FIG. 6.

As the translation cam 122 moves toward the first position, each of the pressing members 121 is pushed leftward by the sloping front surfaces 141 of the recessed parts 119. Hence, the pressing members 121 move from their release position to their pressing position against the urging force of the compression springs 108.

At the same time, the supply cylinders 98 and the waste-toner-conveying cylinder 104 are pressed leftward by the corresponding pressing members 121. As shown in FIG. 3, the supply cylinders 98 and the waste-toner-conveying cylinder 104 move from their retracted position to their advanced position against the urging force of the compression springs 103 and are inserted through the through-holes 135 formed in the partitioning wall 131.

Consequently, each of the supply cylinders 98 contacts the right ends of the process-side shutters 71 in the corresponding process cartridges 26 from the right side. As the supply cylinders 98 are pressed further leftward, each of the supply cylinders 98 is inserted into the corresponding receiving cylinders 69 against the urging force of the compression springs 73 while pressing the process-side shutters 71 leftward.

When the supply cylinders 98 reach the advanced position, the process-side shutters 71 are disposed in their open position. Similarly, the waste-toner-conveying cylinder 104 is coupled to the waste toner reservoir 87. By inserting the supply cylinders 98 into the receiving cylinders 69 and coupling the waste-toner-conveying cylinder 104 with the waste toner reservoir 87, the toner cartridge drawer 45 is no longer movable in forward and rearward directions.

At this time, the supply openings 99 in the supply cylinders 98 and the first reception openings 70 of the receiving cylinders 69 oppose each other vertically and are in communication. Further, the second receiving ports 109 of the supply cylinders 98 vertically oppose the through-holes 97 of the toner-accommodating sections 95 and are in communication with the same. The fitting parts 102 of the supply cylinders 98 are fitted with the fitting members 75 of the corresponding receiving cylinders 69 through the coupling exposure holes 76 of the process-side shutters 71.

This completes the process for mounting the toner cartridges 46 in the main casing 2.

6. Operations for Supplying Toner from the Toner Cartridges to the Process Cartridges At the beginning of an image-forming operation performed on the printer 1, a drive source (not shown) in the main casing 2 inputs a drive force into the drive input gears 77 of the receiving cylinders 69. As shown in FIG. 3, the drive force is transmitted to the auger screws 100 of the toner cartridges 46 via the couplings 72 of the receiving cylinders 69 for rotating the auger screws 100.

The drive source (not shown) provided in the main casing 2 also inputs a drive force into the drive gears 84 of the toner reservoirs 34. The drive force is transmitted to the toner-conveying members 81 of the toner reservoirs 34 to rotate the same.

As a result, the auger screws 100 convey toner, which has been supplied from the toner-accommodating sections 95 of the toner cartridges 46 into the supply cylinders 98 through the through-holes 97 and second receiving ports 109, leftward through the supply cylinders 98. The toner conveyed leftward in the supply cylinders 98 is supplied through the first reception openings 70 formed in the process cartridges 26 via the supply openings 99.

Toner supplied through the first reception openings 70 is conveyed leftward through the conveying cylinders 68 by the auger screws 83 of the toner-conveying members 81 and is supplied into the toner reservoirs 34 of the process cartridges 26.

Toner supplied to the toner reservoirs 34 is subsequently agitated by the agitators 82 of the toner-conveying members 81 while being conveyed leftward through the toner reservoirs 34. The toner is supplied through the toner supply holes 64 into the first frames 62 of the developing devices 30.

The toner supplied into the first frames 62 is accumulated therein and subsequently supplied to the developing rollers 31 by the supply rollers 32, as described above.

The auger screws 67 in the first frames 62 (see FIG. 1) convey toner in the first frames 62 from the left side toward the right side. Excess toner passes through the toner recovery holes 65 and is collected in the toner reservoirs 34 so that the level of toner in the first frames 62 does not exceed a prescribed level.

7. Mounting and Removing the Process Cartridges

To remove the process cartridges 26 when the process cartridges 26 are mounted in the main casing 2, the operator first places the front cover 7 in the open position, as shown in FIG. 2, thereby exposing the process-side access opening 6.

Next, the operator pulls the process unit 23 forward through the process-side access opening 6. As the process unit 23 is pulled forward, the guide rollers 55 of the process frame 27 are guided in the process-unit guide grooves 134 formed in the main casing 2 until the process unit 23 reaches the pulled-out position.

In this state, the operator can lift the process cartridges 26 up and out of the process frame 27, thereby completing the removal of the process cartridges 26 from the main casing 2.

When mounting the process cartridges 26 in the main casing 2, the procedure for removing the process cartridges 26 described above is performed in reverse. That is, while the process frame 27 is disposed in the pulled-out position, the operator inserts the process cartridges 26 into the process frame 27 from above until the process cartridges 26 are in a prescribed position.

Next, the operator pushes the process unit 23 rearward through the process-side access opening 6. As the process unit 23 moves rearward, the guide rollers 55 of the process frame 27 are guided in the process-unit guide grooves 134 formed in the main casing 2 until the process unit 23 reaches the mounted position.

Next, the operator moves the front cover 7 into its closed position to cover the process-side access opening 6, thereby completing the operation for mounting the process cartridges 26 in the main casing 2.

8. Operational Advantages (1) As illustrated in FIGS. 6, 7, and 8, after the supply cylinders 98 are moved from the advanced position to the retracted position in the printer 1 of the embodiment, the toner cartridge drawer 45 can be pulled in a forward direction from the mounted position out of the main casing 2.

Hence, the toner cartridge drawer 45 having a structure for providing communication between the toner cartridges 46 and process cartridges 26 in the left-to-right direction can be moved forward and rearward by retracting the supply cylinders 98 of the toner cartridges 46 rightward from the process cartridges 26.

With this configuration, the space on the right side of the printer 1 required for mounting and removing the toner cartridges 46 can be greatly reduced, thereby minimizing the space required for installing the printer 1.

Further, even when the printer 1 is installed on a shelf or other location with limited space on left and right sides of the printer 1, the toner cartridge drawer 45 can be pulled forward for replacing the toner cartridges 46. As a result, this configuration enhances the user's options for locations in which the printer 1 can be installed.

(2) As shown in FIGS. 6 and 7, the moving mechanism 111 of the printer 1 can move the supply cylinders 98 of all toner cartridges 46 altogether between the advanced position and retracted position at a time. Therefore, the moving mechanism 111 can move all supply cylinders 98 from the advanced position to the retracted position or from the retracted position to the advanced position in one operation.

(3) As shown in FIG. 2, the translation cam 122 in the printer 1 of the embodiment includes the rack part 120 on the front end thereof. With this construction, an operator can easily access the rack part 120 of the translation cam 122 from the same side (front side) as the toner cartridge drawer 45.

(4) As shown in FIGS. 6 and 7, the supply cylinders 98 can be maintained constantly in the retracted position by the urging force of the compression springs 103, interrupting communication between the supply openings 99 and corresponding first reception openings 70.

Further, through a simple structure for reciprocating the translation cam 122 in forward and rearward directions, the supply cylinders 98 can be moved between the advanced position and retracted position.

(5) As shown in FIGS. 6 and 7, the supply cylinders 98 can be moved to the retracted position in association with the opening operation of the front cover 7 and can be moved to the advanced position in association with the closing operation of the front cover 7.

(6) As shown in FIG. 3, each supply cylinder 98 in the printer 1 has the auger screw 100 for conveying toner toward the supply opening 99. Hence, the printer 1 can reliably convey toner toward the supply opening 99 to maintain a stable supply of toner in the process cartridge 26.

Further, since the auger screw 100 and supply cylinder 98 move together between the retracted position and the advanced position, the auger screw 100 does not interfere with movement of the toner cartridge drawer 45 in the forward and rearward directions. Therefore, the toner cartridge drawer 45 can be moved smoothly in the forward and rearward directions.

(7) With the printer 1 described above, by moving the supply cylinder 98 from the retracted position to the advanced position and coupling the coupling 72 of the receiving cylinder 69 with the fitting part 102 of the supply cylinder 98, as shown in FIG. 3, a drive force generated in the main casing 2 can be transmitted to the supply cylinder 98.

Further, by moving the supply cylinder 98 from the advanced position to the retracted position and decoupling the coupling 72 of the receiving cylinder 69 from the fitting part 102 of the supply cylinder 98, as shown in FIG. 4, transmission of the drive force to the supply cylinder 98 can be cancelled.

(8) As shown in FIG. 9, the process cartridges 26 can be mounted in the main casing 2 or pulled out of the main casing 2 in the front-to-rear direction. Therefore, maintenance can be performed on the process cartridges 26 from the front side of the printer 1.

(9) As shown in FIGS. 3 and 4, direct communication can be established between the toner-accommodating section 95 of the toner cartridge 46 and the toner reservoir 34 of the developing device 30 in the corresponding process cartridge 26, without any separate member interposed therebetween, simply by moving the supply cylinder 98.

(10) As shown in FIGS. 8 and 9, the toner cartridges 46 and process cartridges 26 can be replaced independently of each other by retracting the supply cylinders 98.

(11) As shown in FIG. 3, the supply cylinder 98 of the toner cartridge 46 can open and close the through-hole 97 formed in the toner-accommodating section 95 and can supply toner from the toner-accommodating section 95 leftward.

Hence, operations for opening and closing the through-hole 97 and for supplying toner can be achieved simultaneously through a simple structure that does not require separate members for opening and closing the through-hole 97 and for supplying the toner leftward.

(12) As shown in FIG. 7, the supply cylinder 98 can be maintained constantly in the retracted position by the urging force of the compression spring 103, thereby closing the through-hole 97.

(13) As shown in FIG. 3, the supply cylinder 98 of the toner cartridge 46 includes the auger screw 100 for conveying toner leftward. Hence, through a simple yet reliable construction, a stable supply of toner can be conveyed leftward to the process cartridge 26.

(14) As shown in FIG. 3, a drive force is easily inputted into the fitting part 102 when the supply cylinder 98 is moved to the left side.

9. Variations of the Embodiment

In the embodiment described above, the supply cylinders 98 are moved to the retracted position in association with the opening operation of the front cover 7 and are moved to the advanced position in association with the closed operation of the front cover 7. However, instead of associating the operations of the front cover 7 and translation cam 122, the printer 1 may be configured such that the user directly operates the front end of the translation cam 122 after opening the front cover 7.

In this case, the front cover 7 is not provided with the coupling member 128, and the rack part 120 is not provided on the translation cam 122.

The user first opens the front cover 7 and subsequently pulls the translation cam 122 forward to move the supply cylinders 98 into the retracted position. The user pushes the translation cam 122 rearward to move the supply cylinders 98 into the advanced position.

What is claimed is:

1. An image forming apparatus comprising:

a main casing;

a plurality of image forming units juxtaposedly arrayed with each other in a predetermined direction, each of the plurality of image forming units comprising a photosensitive drum, a developer carrying member disposed in confrontation with the photosensitive drum, and a reception opening configured to receive developer, each photosensitive drum having an axis extending in an axial direction perpendicular to the predetermined direction;

a plurality of developer cartridges configured to be juxtaposedly arrayed with each other in the predetermined direction and each configured to be provided for each of the plurality of image forming units, each of the plurality of developer cartridges being configured to be disposed in confrontation with a corresponding one of the plurality of image forming units in the axial direction, each of the plurality of developer cartridges comprising a developer accommodating section configured to accommodate developer and a supply member having a supply opening through which developer in the developer accommodating section is configured to be supplied to a corresponding one of the plurality of image forming units;

a support member configured to detachably support each of the plurality of developer cartridges and configured to be moved in the predetermined direction between a mounted position in which the support member is mounted in the main casing and a pulled-out position in which the support member is pulled out of the main casing; and a moving mechanism configured to move the supply member between a communication position and an interrupt position when the support member is in the mounted position, wherein, when the supply member is in the communication position, the supply opening and the reception opening are in communication with each other and the support member is incapable of moving in the predetermined direction, and, when the supply member is in the interrupt position, the supply member is moved away from the corresponding one of the plurality of image forming units in the axial direction to interrupt communication between the supply opening and the reception opening and the support member is movable toward the pulled-out position in the predetermined direction.

2. The image forming apparatus according to claim 1, wherein the moving mechanism is configured to move the supply members of all of the plurality of developer cartridges between the communication position and the interrupt position at a time.

3. The image forming apparatus according to claim 1, wherein the moving mechanism has a downstream portion in a pulled-out direction in which the support member moves from the mounted position to the pulled-out position, the downstream portion having an operating portion.

4. The image forming apparatus according to claim 1, wherein each of the plurality of developer cartridges comprises an urging member that urges the supply member toward the interrupt position, wherein the moving mechanism comprises a pressing member configured to be moved between a pressing position in which the pressing member presses the supply member to the communication position and a release position in which the pressing member releases pressure on the supply member; and a moving member configured to be reciprocated along the predetermined direction, wherein the moving member presses the pressing member to the pressing position against an urging force of the urging member to dispose the supply member in the communication position when the moving member is moved to one side of the predetermined direction, and the moving member releases pressure on the pressing member to dispose the supply member in the interrupt position by an urging force of the urging member when the moving member is moved to the other side of the predetermined direction, wherein the pressing member and the moving member are disposed on an opposite side of the supply member from the plurality of image forming units.

5. The image forming apparatus according to claim 1, wherein the main casing includes an opening through which the support member is moved between the mounted position and the pulled-out position and an opening/closing member configured to be moved between an open position in which the opening is exposed and a closed position in which the opening is closed, wherein the moving mechanism moves the supply member from the communication position to the interrupt position in association with movement of the opening/closing member from the closed position to the open position, and the moving mechanism moves the supply member from the interrupt position to the communication position in association with movement of the opening/closing member from the open position to the closed position.

6. The image forming apparatus according to claim 1, wherein the supply member includes a conveying member conveying developer toward the supply opening.

7. The image forming apparatus according to claim 1, wherein each of the plurality of image forming units includes a first coupling member into which a drive force from the main casing is inputted, wherein the supply member includes a second coupling member positioned at a downstream end of the supply member in a direction from the interrupt position to the communication position, the second coupling member being coupled to the first coupling member to be incapable of rotating relative to the first coupling member.

8. The image forming apparatus according to claim 1, wherein the plurality of image forming units is configured to be mounted on and pulled out of the main casing in the predetermined direction.

9. The image forming apparatus according to claim 8, further comprising a support member detachably supporting each of the image forming units and configured to be moved in the predetermined direction between a mounted position in which the support member is mounted in the main casing and a pulled-out position in which the support member is pulled out of the main casing.

10. A developer cartridge comprising:

a developer accommodating section configured to accommodate developer and having a first opening; and a supply member including a second opening and configured to be connected to the developer accommodating section from below to receive developer through the first opening and to convey the received developer in a horizontal direction, wherein the supply member is configured to be moved in the horizontal direction between an open position in which the first opening and the second opening are in communication with each other and a closed position in which the first opening is closed by interrupting communication between the first opening and the second opening, and wherein, when the supply member is in the open position, a downstream end of the supply member in a conveying direction in which developer is conveyed protrudes more outward from the developer cartridge, toward a downstream side of the conveying direction, than when the supply member is in the closed position.

11. The developer cartridge according to claim 10, further comprising an urging member that urges the supply member toward the closed position.

12. The developer cartridge according to claim 10, wherein the supply member includes a conveying member configured to convey developer in the horizontal direction.

13. The developer cartridge according to claim 12, wherein the supply member includes a drive input member positioned at the downstream end of the supply member in the conveying direction, the drive input member being configured to input a drive force into the conveying member.

14. The developer cartridge according to claim 12, wherein the conveying member is an auger screw.

15. A developer cartridge comprising:

a developer accommodating section configured to accommodate developer and having a first opening; and a supply member including a second opening and configured to be connected to the developer accommodating section, wherein the supply member is configured to be moved relative to the developer accommodating section between an open position in which the first opening and the second opening are in communication with each other and a closed position in which the first opening is closed by interrupting communication between the first opening and the second opening, wherein, when the supply member is in the open position, a downstream end of the supply member in a conveying direction in which developer is conveyed protrudes more outward from the developer cartridge, toward a downstream side of the conveying direction, than when the supply member is in the closed position.

16. The developer cartridge according to claim 15, further comprising an urging member that urges the supply member toward the closed position.

17. The developer cartridge according to claim 15, the supply member includes a conveying member configured to convey developer.

18. The developer cartridge according to claim 17, wherein the supply member includes a drive input member positioned at a downstream end of the supply member in the conveying direction, the drive input member being configured to input a drive force into the conveying member.

19. The developer cartridge according to claim 17, wherein the conveying member is an auger screw.

* * * * *